US011686134B2

(12) United States Patent
De Barros et al.

(10) Patent No.: US 11,686,134 B2
(45) Date of Patent: Jun. 27, 2023

(54) MULTI-POCKET LOCK SET

(71) Applicant: Rockwell Security, Inc., San Leandro, CA (US)

(72) Inventors: Jean De Barros, San Francisco, CA (US); Ramesh Satram, San Francisco, CA (US)

(73) Assignee: Rockwell Security, Inc., San Leandro, CA (US)

( * ) Notice: Subject to any disclaimer, the term of this patent is extended or adjusted under 35 U.S.C. 154(b) by 437 days.

(21) Appl. No.: 16/821,199

(22) Filed: Mar. 17, 2020

(65) Prior Publication Data

US 2020/0332576 A1 Oct. 22, 2020

Related U.S. Application Data

(60) Provisional application No. 62/835,589, filed on Apr. 18, 2019.

(51) Int. Cl.

| | |
|---|---|
| ***E05C 9/02*** | (2006.01) |
| ***E05C 3/16*** | (2006.01) |
| ***E05B 63/14*** | (2006.01) |
| ***E05C 9/00*** | (2006.01) |

(52) U.S. Cl.

CPC ..... *E05C 9/02* (2013.01); *E05B 63/14* (2013.01); *E05C 3/16* (2013.01); *E05C 9/006* (2013.01); *E05C 9/025* (2013.01); *Y10T 292/0853* (2015.04); *Y10T 292/1031* (2015.04); *Y10T 292/1055* (2015.04); *Y10T 292/1076* (2015.04)

(58) Field of Classification Search

CPC ... E05C 9/02; E05C 9/006; E05C 3/16; E05C 3/006; E05C 9/025; E05C 9/1875; Y19T 292/0872; Y10T 70/55; Y10T 70/527; Y10T 292/1031; Y10T 292/0839; Y10T 292/1055; Y10T 292/1076; Y10T 292/0967; Y10T 292/1015; Y10T 292/102; Y10T 292/1048; Y10T 292/108; Y10T 292/0853; E05B 63/14

See application file for complete search history.

(56) References Cited

U.S. PATENT DOCUMENTS

| | | | | |
|---|---|---|---|---|
| 1,277,174 A * | 8/1918 | Bakst | E05C 9/06 70/120 |
| 2,989,859 A * | 6/1961 | Eads | E05B 63/0013 292/5 |
| 3,582,119 A * | 6/1971 | Woodworth | E05B 63/127 292/29 |
| 3,899,906 A * | 8/1975 | Bradstock | E05B 63/0013 292/200 |

(Continued)

*Primary Examiner* — Christine M Mills
*Assistant Examiner* — Faria F Ahmad
(74) *Attorney, Agent, or Firm* — Sughrue Mion, PLLC

(57) ABSTRACT

A multi-point locking set, comprising an engagement member attached to a first end of an actuator plate and configured to move the actuator plate in a vertical direction, a locking member attached to a second end of the actuator plate and attached to a first moving plate and a second moving plate, wherein the locking member pivots between a retracted position and an extended position when the actuator plate moves in the vertical direction, and wherein the first moving plate and the second moving plate move in a vertical direction when the locking member pivots between the retracted position and the extended position.

19 Claims, 6 Drawing Sheets

(56) References Cited

U.S. PATENT DOCUMENTS 4,132,438 A * 1/1979 Guymer ..... E05B 65/0811 292/111
4,387,918 A * 6/1983 Dunphy ..... E05B 63/0013 292/229
4,643,005 A * 2/1987 Logas ..... E05C 9/026 70/95
4,964,660 A * 10/1990 Prevot ..... E05B 63/14 292/DIG. 55
4,973,091 A * 11/1990 Paulson ..... E05C 9/042 292/216
5,148,691 A * 9/1992 Wallden ..... E05B 47/0012 292/201
5,197,771 A * 3/1993 Kaup ..... E05C 9/047 292/DIG. 21
5,290,077 A * 3/1994 Fleming ..... E05C 9/185 292/DIG. 60
5,373,716 A * 12/1994 MacNeil ..... E05C 9/1808 70/489
5,382,060 A * 1/1995 O'Toole ..... E05C 7/06 292/336.3
5,722,704 A * 3/1998 Chaput ..... E05C 9/047 292/26
5,906,403 A * 5/1999 Bestler ..... E05C 9/1808 292/DIG. 60
6,733,051 B1 * 5/2004 Cowper ..... E05B 63/242 292/192
6,776,441 B2 * 8/2004 Liu ..... E05B 63/14 292/DIG. 60
6,871,451 B2 * 3/2005 Harger ..... E05B 63/185 49/449
6,971,686 B2 * 12/2005 Becken ..... E05C 7/04 292/172
8,182,002 B2 * 5/2012 Fleming ..... E05B 15/004 292/68
8,348,308 B2 1/2013 Hagemeyer et al.
8,534,099 B2 * 9/2013 Wheeler ..... E05C 9/042 70/108
8,840,153 B2 * 9/2014 Juha ..... E05C 9/20 49/394
8,850,744 B2 * 10/2014 Bauman ..... E05C 9/1875 49/394
8,973,416 B2 * 3/2015 Terei ..... E05B 57/00 70/105
9,765,550 B2 * 9/2017 Hemmingsen ..... E05B 65/00
9,790,716 B2 * 10/2017 Hagemeyer ..... E05C 9/00
10,435,927 B2 * 10/2019 Arlinghaus ..... E05C 9/185
10,808,424 B2 * 10/2020 Griddle ..... E05B 47/02
10,876,324 B2 * 12/2020 Jaskiewicz ..... E05B 15/0013
2005/0103066 A1 * 5/2005 Botha ..... E05C 9/047 70/107
2008/0092606 A1 * 4/2008 Meekma ..... E05C 9/20 70/120
2008/0156048 A1 * 7/2008 Topfer ..... E05B 65/1086 70/77
2008/0184749 A1 * 8/2008 Alber ..... E05C 9/041 70/103
2011/0198867 A1 * 8/2011 Hagemeyer ..... E05B 63/14 292/161

* cited by examiner

MULTI-POCKET LOCK SET

CROSS REFERENCE TO RELATED APPLICATIONS

This application claims priority to U.S. Patent Application No. 62/835,589 filed on Apr. 18, 2019, the entire disclose of which is incorporated by reference herein.

BACKGROUND

This disclosure relates generally to high security door locks, and, more particularly to multi-point door locks that utilize standard lock hardware.

Multi-point locks typically include multiple locking members that lock at multiple points at the turn of a key. In general, multi-point locks are designed to transmit motion to other locking members provided in separate locations. Security is increased due to this multitude of locking members and mechanisms. Specifically, utilizing multiple locking members at multiple locations divides the forced entry load throughout the entire door or window panel, instead of focusing the forced entry load to a single spot. This increases the force required for forced entry over single lock systems.

Multi-point locks allow for stable securing of doors and windows, along with improved weather-stripping performance and an optimal weather resistant seal due to their structural configuration. Additionally, because of the numerous locking mechanisms, there is less pressure on the hinges than in single bolt locks. This decrease in pressure reduces wear and tear on the hinges and increases the life span of the lock. Multi-point locks also commonly come in several component sections, allowing manufacturers to utilize different size lock extensions while stocking only the standard locking mechanisms for increased customization for different sizes of doors and windows.

INTRODUCTION

Traditionally, designs for multi-point lock sets require complex structures with a substantial number of components in order to properly engage multiple locking members in separate locations. Complex structures involving a substantial number of components are both costly to create and difficult to manufacture on a commercial scale. Further, additional components within a locking mechanism increases the difficulty of repair and maintenance.

To mitigate the issues that result from additional components, a multi-point lock, in a first embodiment, may comprise: an engagement member attached to a first end of an actuator plate and configured to move the actuator plate in a vertical direction, a locking member attached to a second end of the actuator plate and attached to a first moving plate and a second moving plate, wherein the locking member pivots between a retracted position and an extended position when the actuator plate moves in the vertical direction, and wherein the first moving plate and the second moving plate move in a vertical direction when the locking member pivots between the retracted position and the extended position.

A second embodiment of a multi-point lock may comprise: a dead bolt coupled to a first end of a lever arm, a second end of the lever arm attached to a first end of a linking member by a first pin that rotates when the lever arm is engaged, a boomerang shaped member attached to a second end of the linking member by a second pin that moves in a semicircular path, an actuator plate configured to move in a vertical direction when the boomerang shaped member moves in the semicircular path and is attached to the boomerang shaped member at a first end of the actuator plate, a locking member attached to a second end of the actuator plate, and attached to a lower moving plate and an upper moving plate, wherein the locking member pivots in a circular motion between a retracted position and an extended position when the actuator plate moves in a vertical direction, and wherein the circular motion of the locking member moves the upper moving plate and the lower moving plate vertically in opposing directions.

A third embodiment of a multi-point lock may comprise: an engagement member attached to a first end of an actuator plate, a spring-biased actuator configured to move an actuator plate in a vertical direction and is attached to the engagement member at the first end of the actuator plate, a locking member attached to a second end of the actuator plate, and attached to a lower moving plate and an upper moving plate, wherein the locking member pivots between a retracted position and an extended position when the actuator plate moves in a vertical direction.

BRIEF DESCRIPTION OF THE DRAWINGS

These and other objects, features and advantages will become apparent from the following detailed description of illustrative embodiments, which is to be read in connection with the accompanying drawings. The various features of the drawings are not to scale as the illustrations are for clarity in facilitating one skilled in the art in understanding this disclosure in conjunction with the detailed description. In the drawings.

DETAILED DESCRIPTION OF THE DRAWINGS

Detailed embodiments of the claimed structures are disclosed herein; however, it can be understood that the disclosed embodiments are merely illustrative of the claimed structures that may be embodied in various forms. Aspects of this disclosure may, however, be embodied in many different forms and should not be construed as limited to the exemplary embodiments set forth herein. Rather, these exemplary embodiments are provided so that this disclosure will be thorough and complete and will fully convey the scope of this disclosure to those skilled in the art. In the description, details of well-known features and techniques may be omitted to avoid unnecessarily obscuring the presented embodiments.

Figure 1:
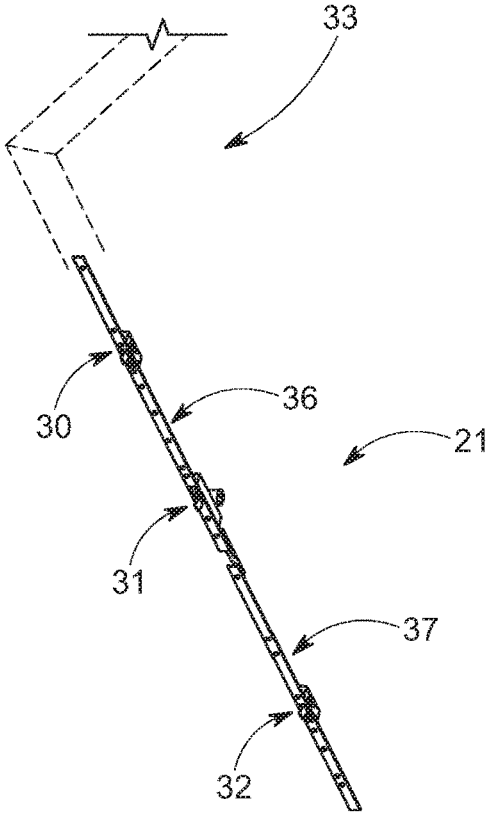
FIG. 1 is a schematic perspective view of a multi-point lock in accordance with one embodiment of the invention.

FIG. 1 depicts a schematic perspective view of a multi-point lock 21 with separate housings in accordance with one embodiment of the invention. The separate housings may include an upper housing 30, a middle housing 31, and a lower housing 32. The housings are inserted into recesses within a side of a door 33, such as a door stile. The housings may also be inserted into recesses within the side of a window (not depicted). Each of the housings includes at least the mechanisms that control the movement of a locking member 5 from an unlocked position to a locked position, which will be described in further detail below. The middle housing 31 is separately attached to the door 33 at a location adjacent to a deadbolt receiving portion 34 configured to receive a deadbolt lock 35. The upper housing 30 and the lower housing 32 are separately attached to the door 33 at locations distal from the middle housing 31. The locking mechanism 38 within the middle housing 31 control the movement of the locking mechanisms within the upper housing 30 and the lower housing 32 in the manner discussed in FIG. 4A-4C, below.

As depicted in FIG. 1, the upper housing 30 and middle housing 31 are secured to an upper cover plate 36. The lower housing 32 is likewise secured to a lower cover plate 37. The cover plates may be secured to the housings by securing members, such as screws. The cover plates may be secured to each other by securing members. The cover plates may be secured to the door stile or window stile by securing members, such as screws.

Figure 2:
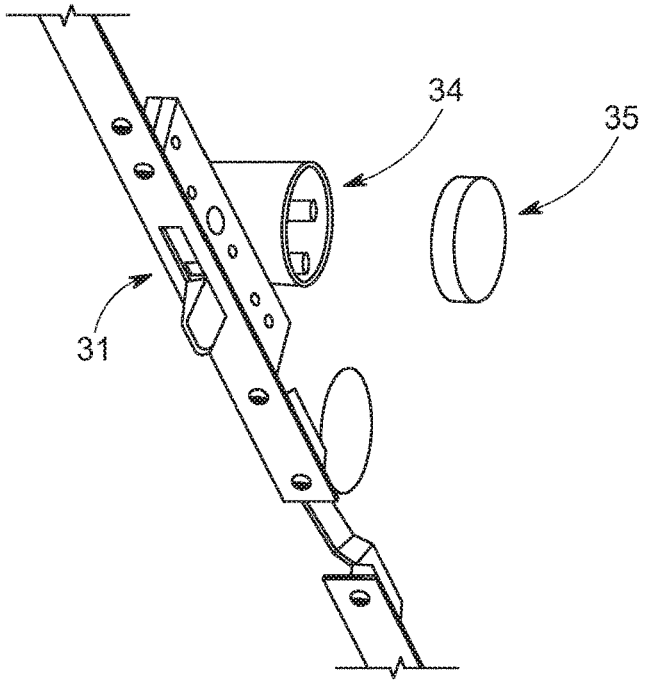
FIG. 2 is an enlarged schematic perspective view of the middle housing and the dead bolt receiving portion.

FIG. 2 depicts an enlarged schematic perspective view of the middle housing 31 and the dead bolt receiving portion 34. The dead bolt receiving portion 34 may receive any conventional dead bolt. The dead bolt receiving portion may also receive conventional hooked locks. The dead bolt receiving portion 34 attaches to a side of the middle housing 31. The middle housing 31, which includes more components discussed in detail below, may be longer than the upper housing 30 and the lower housing 32. The width and depth of the upper, middle, and lower housings are the same. The upper housing 30 and the lower housing 32 may contain substantially the same components as the middle housing 31, specifically the mechanisms that control the movement of a locking member 5 from an unlocked position to a locked position. The upper housing 30 and the lower housing 32 may contain substantially the same components as each other.

Figure 3:
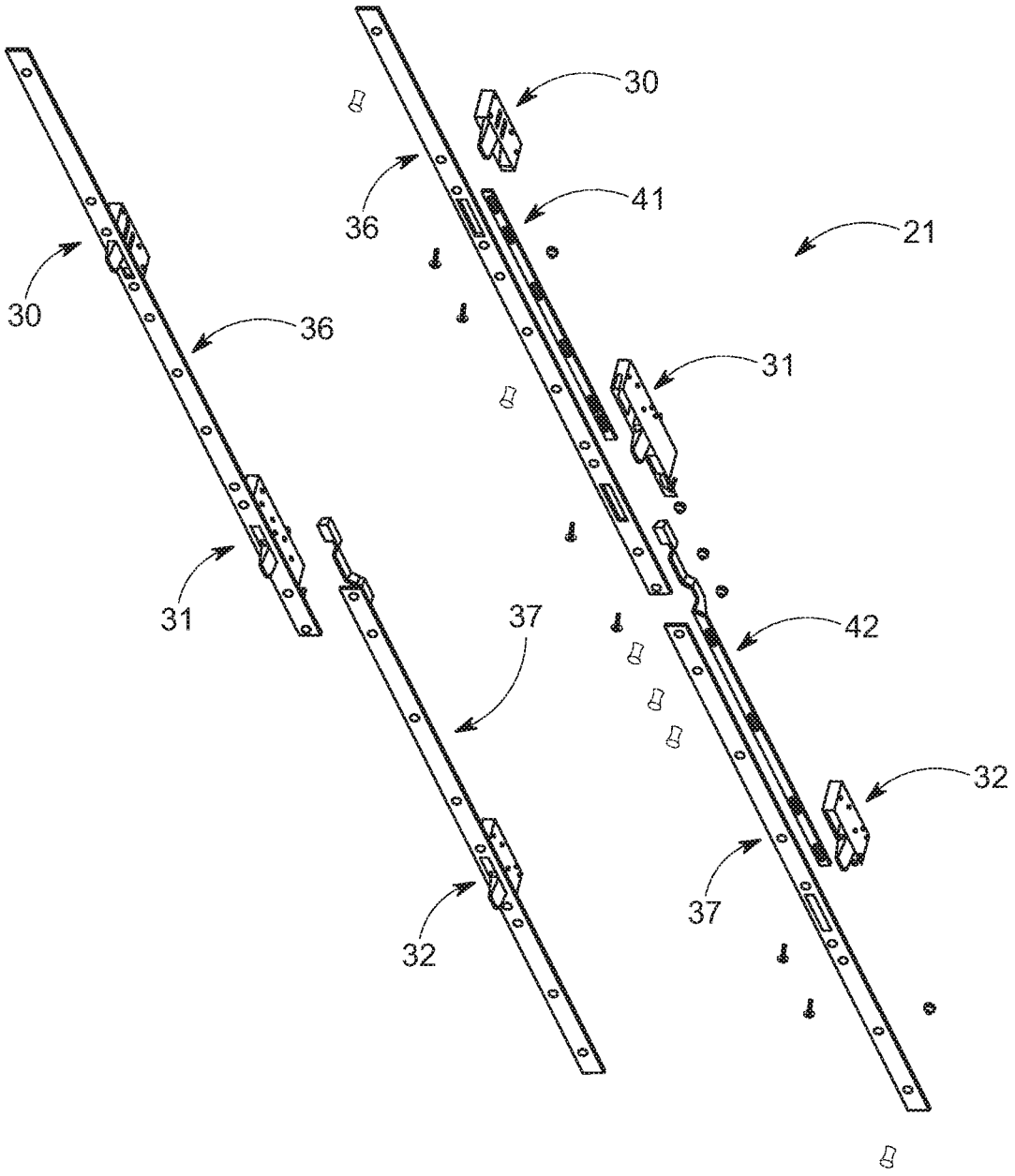
FIG. 3 is an exploded perspective view of a multi-point lock in accordance with one embodiment of the invention.

FIG. 3 depicts a partially exploded perspective view (left) and an exploded perspective view (right) of a multi-point lock 21 with separate housings in accordance with one embodiment of the invention. As depicted in FIG. 3, the multi-point lock 21 may include a lower moving rail 42 and an upper moving rail 41 that are used to actuate locking members (not depicted) within the lower housing 32 and upper housing 30. The upper moving rail 41 and lower moving rail 42 may including slots with pins that secure the upper moving rail 41 to the upper cover plate 36 and the lower moving rail 42 to the lower cover plate 37. The pins move vertically within the slots on the upper and lower moving rail when the upper and lower moving rails are engaged, which will be described in further detail below. The top portion of the upper moving rail 41 may be located between the upper housing 30 and the upper cover plate 36. The bottom portion of the upper moving rail 41 may be located between the middle housing 31 and the upper cover plate 36. The bottom portion of the lower moving rail 42 may be located between the lower housing 32 and the lower cover plate 37. The middle housing 31 may be located between the upper cover plate 36 and the top portion of the lower moving rail 42.

FIG. 3 further depicts securing members, such as screws, which secure the upper housing 30 and the middle housing 31 to the upper cover plate 36 and the lower housing 32 to the lower cover plate 37.

Figure 4A:
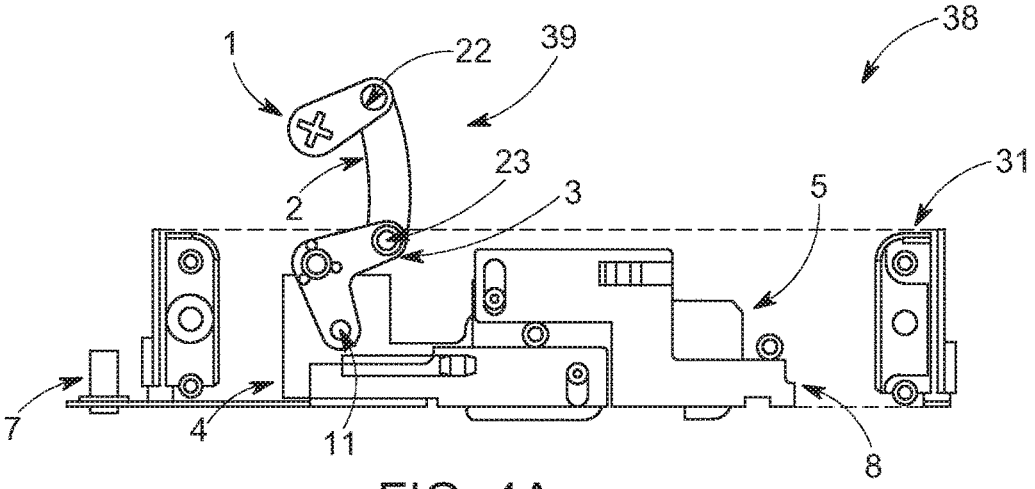
FIG. 4A-4C depicts a partial schematic rear side view of the middle housing and the components therein.
Figure 4B:
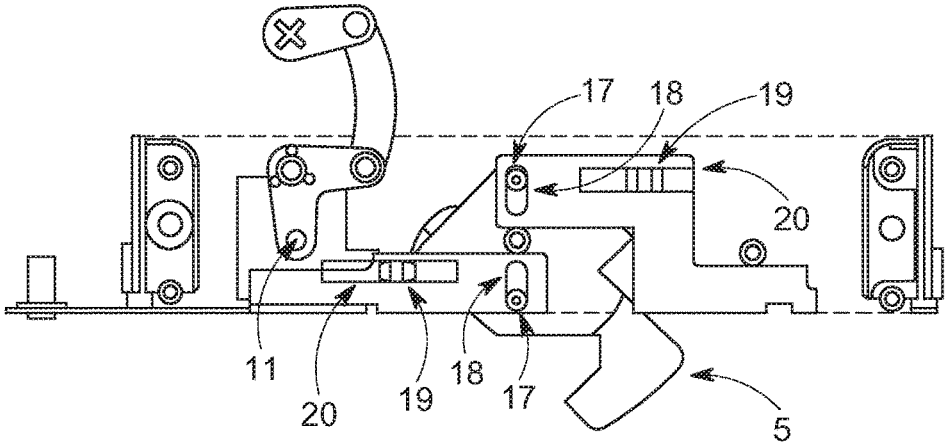
Figure 4C:
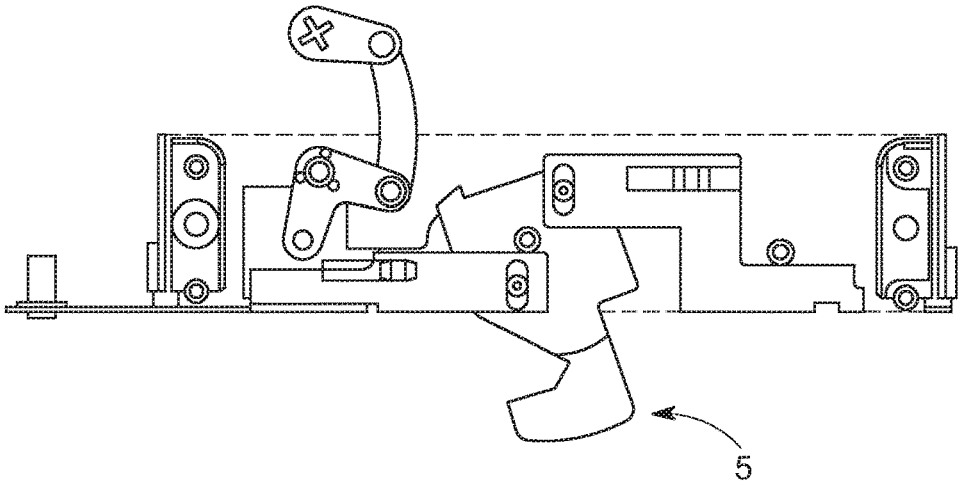

FIG. 4A-4C depicts a partial schematic rear side view of the middle housing 31 and the components therein as the locking mechanism 38 moves from an unlocked position, in FIG. 4A, to a locked position in FIG. 4C. The locking mechanism 38 may include an engagement member 39, an actuator plate 4, a locking member 5, an upper moving plate 8 and a lower moving plate 7. However, the locking mechanism is not limited to this configuration. These components will be described in further detail below.

In a locked position, the locking member 5 of the locking mechanism 38 is locked to a keep within a door frame or window frame. A deadbolt lock 35 is configured to be coupled to a first end of the engagement member 39 via a first end of a lever arm 1. The engagement member 39 may include a lever arm 1, a link 2, and a boomerang 3 but is not limited to this configuration. In this configuration, the locking mechanism 38 may be coupled with different kinds of deadbolt locks and hooked locks. The second end of the lever arm 1 is configured to be connected to a first end of the link 2 by a pin 22. The second end of the link 2 is connected to a first leg of the boomerang 3 via another pin 23. The second leg of the boomerang 3 is connected to a first end of the actuator plate 4 via a pin 11. The second end of the actuator plate 4 is connected to the locking member 5.

Figure 5A:
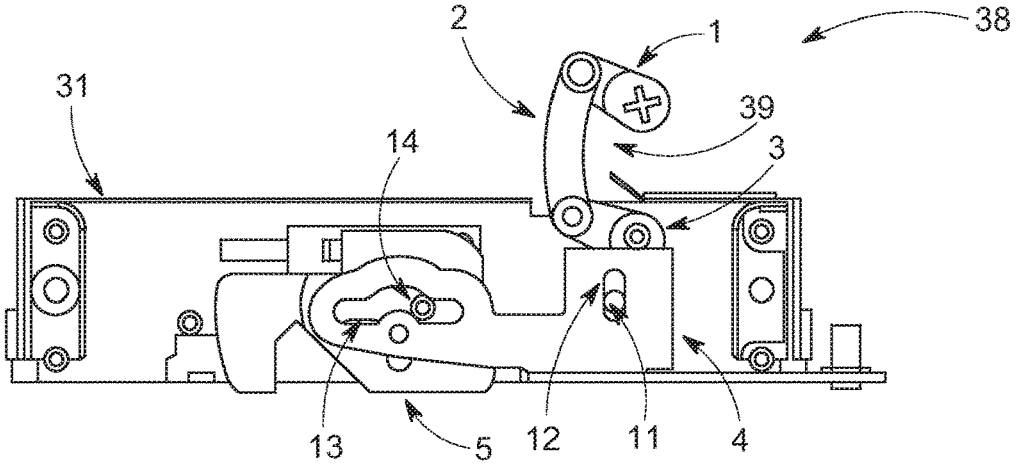
FIG. 5A-5C depicts a partial schematic front side view of the middle housing and the components therein.
Figure 5B:
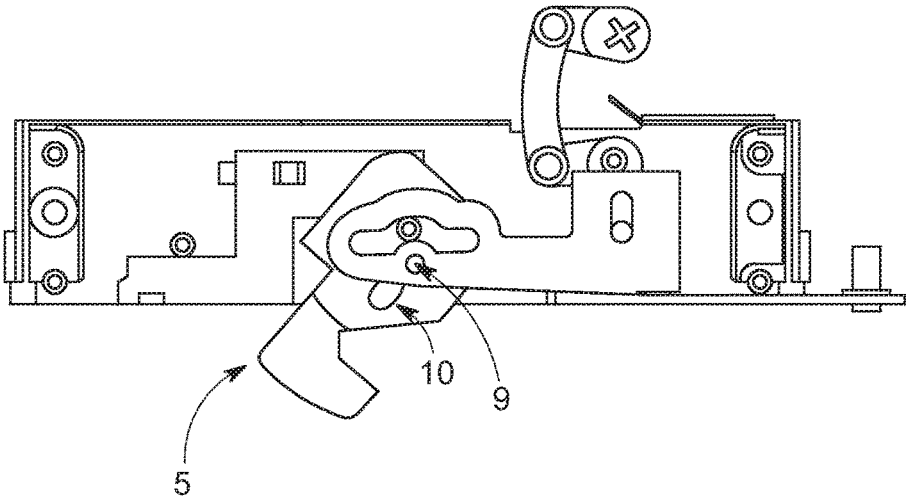
Figure 5C:
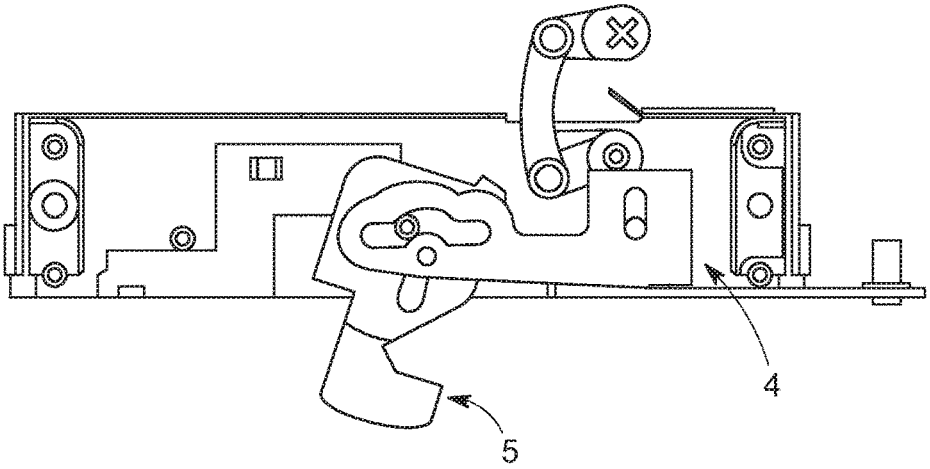

FIG. 5A-5C depicts a partial schematic front side view of the middle housing 31 and the components therein as the locking mechanism 38 moves from an unlocked position, in FIG. 5A, to a locked position in FIG. 5C. As best depicted in FIG. 5A, the boomerang 3 has the first leg connected to the link 2 and the second leg connected to a first horizontal slot 12 at a first end of the actuator plate 4 via a pin 11. The pin 11 is attached to the boomerang 3 and slides in the first horizontal slot 12 at the first end of the actuator plate 4. A second end of the actuator plate 4 has a second, vertical slot 13 with a curved portion provided between a straight first portion and a straight second portion. A pin 14 attached to the locking member 5 is provided within the slot 13. A pin 9 is attached directly to the actuator plate 4 and is provided within an L-shaped slot 10 on one side of the locking member 5.

As depicted in FIG. 4A-4C, the rear side of the locking member 5 has two pivot pins 17 that are provided at opposing ends of the locking member 5. As best depicted in FIG. 5A, the front side of the locking member 5 has a pivot pin 14 that slides within the vertical slot 13 of the actuator plate 4 when the actuator plate 4 is displaced. A front side of the pivot pin 14 is pinned to the middle housing 31. A rear side of the pivot pin is also pinned to the middle housing 31.

As depicted in FIG. 4A-4C, the rotation of the lever arm 1 moves the link 2 in a slightly arcing horizontal direction, which causes the boomerang 3 to move in a semicircular path. Rotation of the boomerang 3 in a counterclockwise direction causes the actuator plate 4 to move in a vertical direction. Rotation of the boomerang 3 in a clockwise direction causes the actuator plate 4 to move in an opposing vertical direction. The actuator plate 4 first moves in a vertical direction as the pivot pin 14 slides within the first straight portion of the slot 13, then moves in a slightly arcing manner when the pin slides within the curved portion of the slot 13, and then moves in the vertical direction again when the pivot pin 14 slides within the second straight portion of the slot 13. Both sides of the actuator plate 4 move in the same manner.

As depicted in FIG. 5A-5C, the pin 9, which is directly connected to the actuator plate 4, moves within the L-shape slot 10 on the locking member 5. The movement of the actuator plate 4 causes the pin 9 to move within the L-shaped slot 10 on the locking member 5, which in turn causes the locking member 5 to pivot from the retracted position to the extended position, and vice versa, via the pivoting pin 14. In this way, the locking member 5 itself is used to transfer movement from the actuator plate 4 to the lower and upper moving plate 7, 8, which transfers movement to a lower and an upper moving rail 41, 42 that are used to actuate locking members (not depicted) within the lower housing 32 and upper housing 30. The lower and upper moving plates 7, 8 are connected to lower and upper moving rails 41, 42. The locking members are locked to respective keeps within the door frame or window frame.

As depicted in FIG. 4A, the rear side of the locking member 5 has a top pivot pin 17 and a bottom pivot pin 17, protruding on opposite ends of the locking member 5. The top pivot pin 17 on the locking member 5 is connected to a slot 18 on the upper moving plate 7, and the bottom pivot pin 17 is connected to a slot 18 on the lower moving plate 7. The circular motion of the locking member 5, while it is extending or retracting, drives the lower and upper moving plates 7, 8 vertically in opposing directions. As best depicted in FIG. 4A, tabs 19 attached to the lower and upper moving plates 7, 8 slide within slots 20 formed in the middle housing 31. The tabs 19 and slots 20 are used to guide movement of the plates 7, 8. The lower and upper moving rails 41,42 are in turn connected via pins to slots within upper and lower actuator plates (not depicted) within the upper and lower housings, 30, 32 respectively. The upper and lower actuator plates move in the same manner as the actuator plate 4 discussed above.

Moreover, as with the actuator plate 4, pins on the lower and upper actuator plates within the upper housing 30 and lower housing 32, are provided within L-shaped slots on lower and upper locking members 44 (not depicted). The vertical movement of the lower and upper moving rails 41, 42 drives the vertical movement of the lower and upper actuator plates. The vertical movement of the pins within the actuator plates within the L-shaped slots of the upper and lower locking members drive the circular rotational movement of the upper and lower locking members from the retracted to extended positions in a similar manner as the locking member 5 depicted in FIG. 4A-4C and FIG. 5A-5C.

Figure 6:
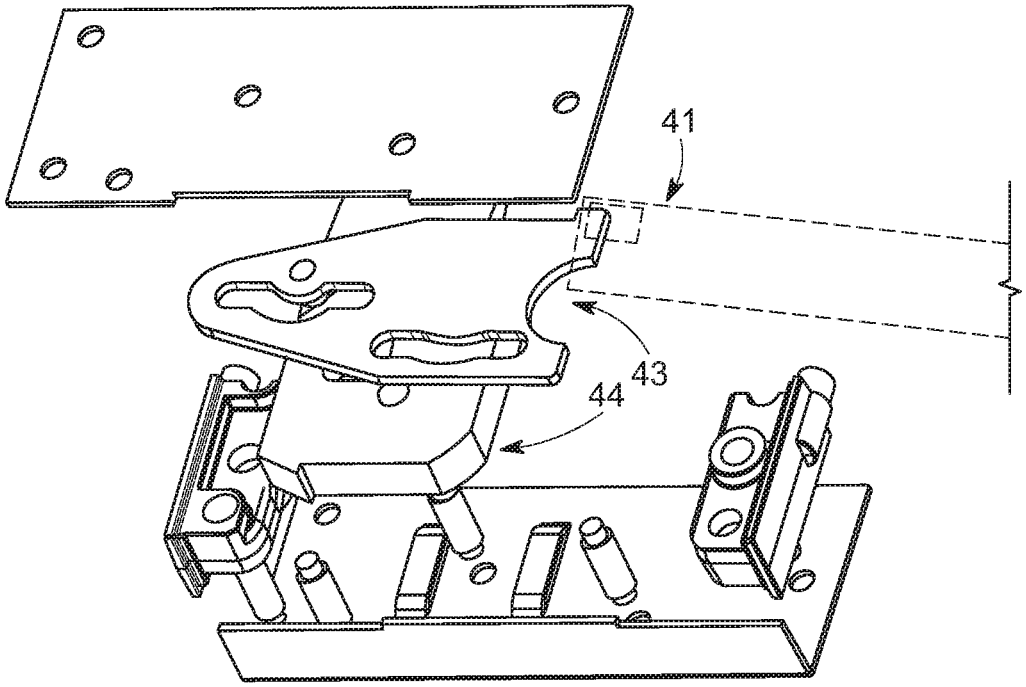
FIG. 6 depicts an exploded schematic perspective view of either the upper or lower housing and the components therein.

FIG. 6 depicts an exploded schematic perspective view of either the upper or lower housing 30, 32. The upper housing 30 and the lower housing 32 may contain similar components. The upper housing 30 may include an actuator plate 43, a locking member 44, and a plurality of pins. As described above, the actuator plate 43 is provided with pins within an L-shaped slot on the locking member 44. When the upper moving rail 41 moves vertically, the actuator plate 43 is moved vertically and causes the locking member 43 to rotate from a retracted to an extended position in a similar manner as the locking member 5 depicted in FIG. 4A-4C and FIG. 5A-5C.

Figure 7:
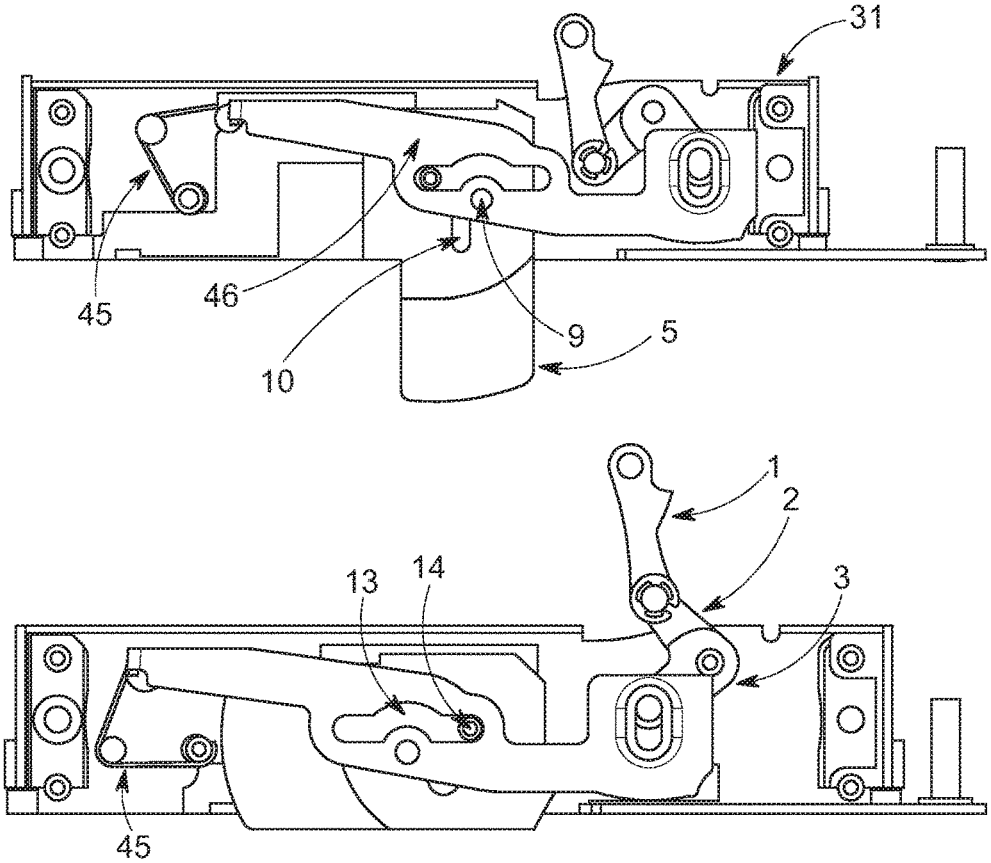
FIG. 7 depicts a partial schematic front side view of the middle housing and the components therein for another exemplary embodiment.

FIG. 7 depicts a partial schematic front side view of the middle housing 31 and the component therein for another exemplary embodiment. As depicted in FIG. 7, the actuator plate 46 is elongated, as compared to the actuator plate 4 in the previous embodiment, and spring biased by utilizing an elastic member 45. The rotation of the lever arm 1 moves the link 2 in a slightly arcing horizontal direction, which causes the boomerang 3 to move in a semicircular path. Rotation of the boomerang 3 in a counterclockwise direction causes the actuator plate 46 to move in a vertical direction. Rotation of the boomerang 3 in a clockwise direction causes the actuator plate 4 to move in an opposing vertical direction. The actuator plate 46 first moves in a vertical direction as the pivot pin 14 slides within the first straight portion of the slot 13, then moves in a slightly arcing manner when the pin slides within the curved portion of the slot 13, and then moves in the vertical direction again when the pin slides within the second straight portion of the slot 13. The movement of the actuator plate 46 causes the pin 9 to move within the L-shaped slot 10 on the locking member 5, which in turn causes the locking member 5 to pivot from the retracted position to the extended position, and vice versa, via the pivoting pin 14.

The elastic member 45 may act as a bi-stable mechanism. The elastic member 45 is engaged as the pin 14 moves through the curved portion of the slot 13 and assists the actuator plate 46 to continue to move to a final position when the pin 14 reaches the end of the second straight portion of the slot 13. The elastic member 45 is also engaged when the actuator plate is moving in the opposing vertical direction and the pin 14 moves through the curved portion of the slot 13. The elastic member 45 assists the actuator plate 46 to continue to move to a position when the pin 14 reaches an end of the first straight portion of the slot 13.

A first end of the elastic member 45 is attached to the actuator plate 46. A second end of the elastic member 45 is attached to the middle housing 31 by a securing member, such as a screw. Both sides of the actuator plate 46 move in the same manner when engaged.

Figure 8:
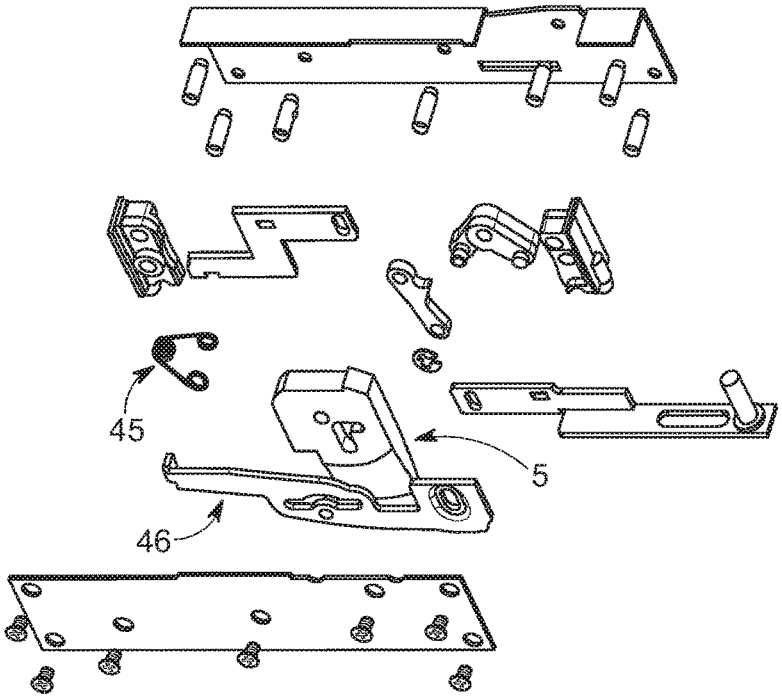
FIG. 8 depicts an exploded schematic perspective view of the middle housing and the components therein for the embodiment of FIG. 7.

FIG. 8 depicts an exploded schematic perspective view of the middle housing 31 and the components therein for another exemplary embodiment. As depicted in FIG. 7, the actuator plate 46 is hooked at the elongated end. The hook portion of the actuator plate 46 attaches to the first end of the elastic member 45. The lever arm 1, link 2, boomerang 3, and locking member 5, are substantially the same as those used in the previous embodiment. The first moving rail and the second moving rail are also substantially the same as those used in the previous embodiment.

The descriptions of the various aspects and embodiments have been presented for purposes of illustration, but are not intended to be exhaustive or limited to the embodiments disclosed. Even though combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set. Many modifications and variations will be apparent to those of ordinary skill in the art without departing from the scope of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A lock comprising:

an engagement member attached to a first end of an actuator plate and configured to move the actuator plate in a vertical direction, a locking member attached to a second end of the actuator plate and attached to an upper moving plate and a lower moving plate, wherein the locking member pivots between a retracted position and an extended position when the actuator plate moves in the vertical direction, and wherein the upper moving plate and the lower moving plate move in the vertical direction when the locking member pivots between the retracted position and the extended position;

wherein a first pivot pin is provided on the locking member and the first pivot pin slides within a first slot on the actuator plate.

2. A lock as described in claim 1, wherein each of the upper moving plate and the lower moving plate is respectively configured to move at least a second actuator plate in the vertical direction and at least a second locking member that pivots between a retracted position and an extended position when the second actuator plate moves in the vertical direction.

3. A lock as described in claim 1, wherein the engagement member comprises:

a lever arm attached to a first end of a linking member that rotates when the lever arm is engaged, and a boomerang shaped member attached to a second end of the linking member and attached to a first end of the actuator plate.

4. The lock as described in claim 1, wherein a second pivot pin and a third pivot pin are provided on the locking member, the second pivot pin slides within a slot on an upper moving plate, and the third pivot pin slides within a slot on a lower moving plate.

5. The lock as described in claim 1, further comprising a middle housing that houses the engagement member, the actuator plate, the locking member, and a portion of a lower moving plate and a portion of an upper moving plate.

6. The lock as described in claim 1, wherein the locking member includes an L-shaped slot, and a second pin connected to the actuator plate moves within the L-shaped slot.

7. The lock as described in claim 4, wherein the first pivot pin and the second pivot pin are provided on opposite sides of the locking member.

8. The lock as described in claim 5, wherein the middle housing is attached to a door at a location adjacent to a dead bolt receiving port configured to receive a deadbolt lock.

9. The lock as described in claim 5, further comprising an upper housing that houses a portion of the upper moving plate and a lower housing that houses a portion of the lower moving plate.

10. The lock as described in claim 4, wherein the slot on the upper moving plate and the slot on the lower moving plate are vertical.

11. The lock as described in claim 9, wherein the middle housing is longer than the upper housing and the lower housing.

12. A lock, comprising:

a dead bolt coupled to a first end of a lever arm, a second end of the lever arm attached to a first end of a linking member by a first pin that rotates when the lever arm is engaged, a boomerang shaped member attached to a second end of the linking member by a second pin that moves in a semicircular path, an actuator plate configured to move in a vertical direction when the boomerang shaped member moves in the semicircular path and is attached to the boomerang shaped member at a first end of the actuator plate, a locking member attached to a second end of the actuator plate, and attached to a lower moving plate and an upper moving plate, wherein the locking member pivots in a circular motion between a retracted position and an extended position when the actuator plate moves in the vertical direction, and wherein the circular motion of the locking member moves the upper moving plate and the lower moving plate vertically in opposing directions.

13. A lock as described in claim 12, wherein the upper moving plate and the lower moving plate are configured to move at least a second actuator plate in the vertical direction and at least a second locking member that pivots between a retracted position and an extended position when the second actuator plate moves in the vertical direction.

14. The lock as described in claim 5, wherein a first tab is provided on the upper moving plate and a second tab is provided on the lower moving plate, and the first and the second tab slide within slots formed in the middle housing.

15. The lock as described in claim 9, wherein the lower moving plate is connected to a lower rail and the upper moving plate is connected to an upper rail, and the lower rail and the upper rail are connected via pins to slots within a lower actuator plate and an upper actuator plate within the lower housing and the upper housing.

16. The lock as described in claim 15, wherein pins within the lower actuator plate and upper actuator plate are provided within L-shaped slots on a lower locking member and an upper locking member.

17. The lock as described in claim 16, wherein movement of the pins within the actuator plate within L-shaped slots of the upper locking member and the lower locking member drives rotational movement of the upper locking member and the lower locking member from the retracted to extended positions.

18. A lock comprising:

an engagement member attached to a first end of an actuator plate, an elastic member configured to move an actuator plate in the vertical direction and is attached to the engagement member at the first end of the actuator plate, a locking member attached to a second end of the actuator plate, and attached to a lower moving plate and an upper moving plate, wherein the locking member pivots between a retracted position and an extended position when the actuator plate moves in a vertical direction.

19. A lock as described in claim 18, wherein the upper moving plate and the lower moving plate are configured to move at least a second actuator plate in the vertical direction and at least a second locking member that pivots between a retracted position and an extended position.

* * * * *